US006443058B1

(12) United States Patent
Stadler et al.

(10) Patent No.: US 6,443,058 B1
(45) Date of Patent: Sep. 3, 2002

(54) COMBINED PRINTING METHOD AND HYBRID PRINTING MACHINE

(75) Inventors: Peter Stadler, Heidelberg; Erich Zahn, Eppelheim; Karl-Heinz Filsinger, Wiesloch; Klaus Sauer, Dielheim-Horrenberg, all of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/531,344

(22) Filed: Mar. 20, 2000

(30) Foreign Application Priority Data

Mar. 19, 1999 (DE) ..... 199 12 309

(51) Int. Cl.[7] ..... B41M 1/18; B41M 1/04; B41M 1/06; B41M 7/00

(52) U.S. Cl. ..... 101/23; 101/142; 101/183; 101/424.1; 101/483; 118/46

(58) Field of Search ..... 101/23, 32, 141, 101/142, 181, 183, 424.1, 483, 491; 118/46

(56) References Cited

U.S. PATENT DOCUMENTS 4,841,903 A * 6/1989 Bird ..... 101/217
5,084,095 A * 1/1992 Fritz ..... 101/491
5,123,343 A * 6/1992 Willer ..... 101/23
5,259,308 A * 11/1993 Wirz ..... 101/230
5,630,363 A * 5/1997 Davis et al. ..... 101/141
5,638,752 A * 6/1997 Hartung et al. ..... 101/177
5,651,316 A * 7/1997 DeMoore et al. ..... 101/424.1

FOREIGN PATENT DOCUMENTS

| | | |
|---|---|---|
| DE | 39 41 571 C2 | 6/1990 |
| DE | 44 35 307 A1 | 4/1996 |
| EP | 0 620 115 B1 | 4/1997 |
| WO | WO 95/20492 | 8/1995 |

OTHER PUBLICATIONS

"Hoher Qualitätsstandard der Druckfarben im Flexodruck" [High Quality Standard of Printing Inks in Flexo–Printing] (Heger), German Printer No. 43, Nov. 1998.

* cited by examiner

*Primary Examiner*—Stephen R. Funk
(74) *Attorney, Agent, or Firm*—Laurence A. Greenberg; Werner H. Stemer; Ralph E. Locher

(57) ABSTRACT

Product is printed in a combined printing process with two ink systems. The printing material is first printed with a solvent-based or radiation-curing ink and then with at least one offset-typical ink. The printing machine for the inline implementation of the novel process is a hybrid press, having a flexo printing unit and a downstream offset printing unit. A UV, electron-beam or air-stream dryer is integrated into the flexo printing unit, or a UV, electron-beam or air-stream drying unit is arranged between the flexo printing unit and the offset printing unit.

12 Claims, 2 Drawing Sheets

COMBINED PRINTING METHOD AND HYBRID PRINTING MACHINE

BACKGROUND OF THE INVENTION

Field of the Invention

The invention lies in the printing technology field. More specifically, the invention relates to a method for the combined printing of a print carrier or stock with two ink systems, and to a printing machine of hybrid construction having a flexo or flexographic printing unit and an offset printing unit disposed downline therefrom, for performing the method.

In recent years, a trend towards labels embellished with metal effects has intensified. In order to produce a four-color printed image bordered with a gold color, paper sheets completely covered with vapor-deposited aluminum are used in label printing works. A four-color print image is then printed onto those sheets by means of an offset printing machine. The offset inks are not printed directly onto the aluminum layer. They are printed onto a covering white primer applied to the aluminum layer. In the region of the border, the covering white primer is left out, and the offset inks black, cyan and magenta are not printed either. In order to produce a gold-colored appearance of the border, only yellow offset ink is printed directly onto the aluminum layer in the region of the border.

The use of paper sheets on which aluminum has been vapor-deposited is unfavorable, however, both from a cost point of view and from an environmental point of view (recycling). Technological problems also occur at the works which process the labels when the labels are detached from their carriers. For example, the labels of reusable, recyclable bottles have to be detached from the bottles before they are refilled. For that purpose the bottles are immersed in baths of alkaline solution. Because of the comparatively low adhesion of the covering white primer to the aluminum layer, the covering white primer and, together with this, the offset inks are already detached from the aluminum layer before the label is detached from the bottle. The detached covering white and the detached offset inks block the filters of the label removing plant.

A printing machine having a number of offset printing units, a flexo printing unit upstream of the offset printing units and a varnishing unit downstream of the offset printing units is described and shown in European patent EP 0 620 115 B1 (FIG. 2). Using a configuration of this type it is theoretically possible to print the above-mentioned paper sheets on which aluminum has been vapor-deposited, in that the covering white basic coating is applied by means of the flexo printing unit and the four-color print is applied onto that by means of the offset printing units.

Moreover, U.S. Pat. No. 5,630,363 describes a method for the combined printing of a printing material according to the flexographic printing and offset printing principle. German published patent application DE 44 35 307 A1 describes a method for the embossing and subsequent printing of a printing material.

SUMMARY OF THE INVENTION

It is accordingly an object of the invention to provide a novel printing machine and an associated process, which overcomes the above-mentioned disadvantages of the heretofore-known devices and methods of this general type and which renders it possible to produce metal effects cost-effectively on the printing materials serving for the production of labels or packaging. It is a further object to provide a printing machine by means of which the method can be implemented in a technologically beneficial way.

With the foregoing and other objects in view there is provided, in accordance with the invention, a printing method, which comprises: printing a printing material in a combined printing process with two ink systems, and thereby first printing onto the printing material an ink selected from the group of solvent-based inks and radiation-curing inks; and subsequently printing onto the printing material at least one offset-typical ink with an offset printing process.

In accordance with an added feature of the invention, the product is first printed with a metallic ink before being forwarded to the offset printing unit(s).

In accordance with an additional feature of the invention, the first printing step comprises printing the printing material several times with inks selected from the group consisting of solvent-based and radiation-curing inks prior to printing with the offset-typical ink.

The method according to the invention for the combined printing of a printing material with two ink systems is distinguished by the fact that the printing material is first printed with an ink which can be dried by radiation or with a solvent-containing ink—especially in each case with such a metallic ink—and is then printed with an offset ink and preferably with a number of offset inks.

With the method according to the invention, it is possible to produce labels, folding boxes or the like decorated with metal effects without the use of printing-material sheets on which aluminum has been vapor-deposited. The solvent-based or radiation-curing ink does not need to be applied to the entire area of the printing material, nor overprinted with the offset-typical ink. Therefore, no covering white primer is required either, and the problems associated with this when the labels are being detached from labelled products are also eliminated.

In a refinement of the method which develops the method according to the invention and is advantageous with regard to the achievement of a high ink layer thickness on the printing material, before being printed with the offset ink or the offset inks, the printing material is first printed at least twice, one after another, with the solvent-based or radiation-curing ink. In this case, it is possible to print twice, one after another, with precisely the same solvent-based or the same radiation-curing ink. However, it is also possible for two different solvent-based or two different radiation-curing inks to be printed one after another. For example, in one case the two solvent-based inks and in the other case the two radiation-curing inks can each differ from each other slightly in terms of their viscosity, composition or pigments.

In a refinement of the method which is advantageous with regard to spot coating of the printing material, in order to print the printing material with the solvent-based or radiation-curing ink or with the solvent-based or radiation-curing inks, the flexographic printing principle is used in each case. The solvent-based or radiation-curing ink can therefore be placed on the printing material in a manner suitable for the printed image. In printed-image regions where the offset-typical ink is printed directly onto the printing material, the printing-material coating with the solvent-based or radiation-curing ink is left out.

In accordance with another feature of the invention, which is advantageous with regard to "wet on dry" printing, after being printed with the solvent-based ink or with the solvent-based inks, the printing material is air-dried. In the case of the printing of the printing material twice, one after another, using the solvent-based ink/inks, first intermediate air-drying directly following the first printing process, and second intermediate air-drying directly following the second printing process are advantageous.

In a refinement of the method which is likewise advantageous with regard to "wet on dry" printing, after being printed with the radiation-curing ink/inks, the printing material and, put more precisely, the ink printed on it, is dried by irradiation with ultraviolet light or electron bombardment. If the printing material is printed twice, one after another, with radiation-curing inks, first UV or electron irradiation directly following the first printing process, and second UV or electron irradiation directly following the second printing process are advantageous. In many applications, however, "wet on wet" printing of the two solvent-based inks or the two radiation-curing inks can also be carried out. In this case, no intermediate drying needs to be carried out between the first and second printing process using the solvent-based or radiation-curing ink, and it is sufficient for the intermediate drying to be carried out between the last printing of the printing material with the solvent-based or radiation-curing ink and the first printing of the printing material with the offset-typical ink.

In a refinement of the method which is advantageous with regard to the application of a transparent protective varnish to the printing material, after printing with the single offset ink or the last of a number of offset inks, the printing material is printed with a water-based ink especially an emulsified varnish. Water-based inks and varnishes are very environmentally friendly, so that a protective varnish covering the entire printed format is possible without damaging emissions.

In a refinement of the method which is advantageous with regard to the application of a spot varnish to the printing material, the printing of the printing material with the water-based ink or with the emulsified varnish is carried out using the flexographic printing principle. The relief print form used in flexographic printing and made of elastic polymer is raised only at the printing points. It is therefore possible to provide selected regions within the entire printed format with a decorative glossy varnish.

In a refinement of the method which is advantageous with regard to finishing the printing material, the printing material is perforated, stamped, fluted, embossed or the like before being printed for the first time with an offset ink. By means of this finishing, preceding the offset printing and dividing and/or deforming the printing material, the printed image produced by means of the offset printing is not destroyed. The offset-typical ink is transferred to the finished printing-material surface by a rubber blanket, which makes very good contact with a relief on the printing-material surface produced during finishing. In this way, the offset ink can be printed, with equally good print quality and area coverage, on the depressed and elevated embossed regions produced during embossing.

In a refinement of the method which is advantageous with regard to the finishing of the printing material with a fabric-like surface structure, for example a so-called linen appearance, the printed material is embossed before it is printed for the first time with an offset ink. The embossing may be located in that region of the printed image printed with the solvent-based or radiation-curing ink before the embossing, and/or in that region of the printed image printed with the offset ink(s) after the embossing. By means of finely structured and, for example, fluted, lined, dotted embossing, the said fabric-like surface structure can be produced. By means of embossing over a somewhat larger area, it is possible for an embossed text to be produced. If the solvent-based or radiation-curing ink printed onto the printing material before the embossing is a metallic pigment ink, a gold, silver or bronze embossed text may be produced by embossing into its imprint, which appears metallic.

If the offset printing ink(s) are radiation-curing and, for example UV-curing, the embossing can be carried out within the in-line process, following the printing with the offset printing ink(s), by means of an embossing unit downstream of the last offset printing unit.

The printing machine according to the invention of hybrid design, having a flexo printing unit and a downstream offset printing unit, is distinguished by the fact that a UV dryer, an electron-beam dryer or an air-stream dryer forms a constituent part of the flexo printing unit or a drying station separate from the flexo printing unit, which is arranged downstream of the flexo printing unit and upstream of the offset printing unit. It is preferable if the printing machine has two such flexo printing units or flexo printing unit/drying unit pairs in a tandem arrangement.

The printing machine according to the invention is very suitable for the efficient in-line implementation of the method according to the invention. The printed image produced by means of the flexo printing unit or a number of flexo printing units and consisting of the solvent-based or radiation-curing ink has already been dried as a result of the use of the dryer or the drying station when the printing material is printed by the offset printing unit. Contamination of the offset-typical ink printed by means of the offset printing unit as a result of any deposition of a solvent-based or radiation-curing and not yet completely dried metallic ink is thus ruled out absolutely.

Other features which are considered as characteristic for the invention are set forth in the appended claims.

Although the invention is illustrated and described herein as embodied in a printing method and machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
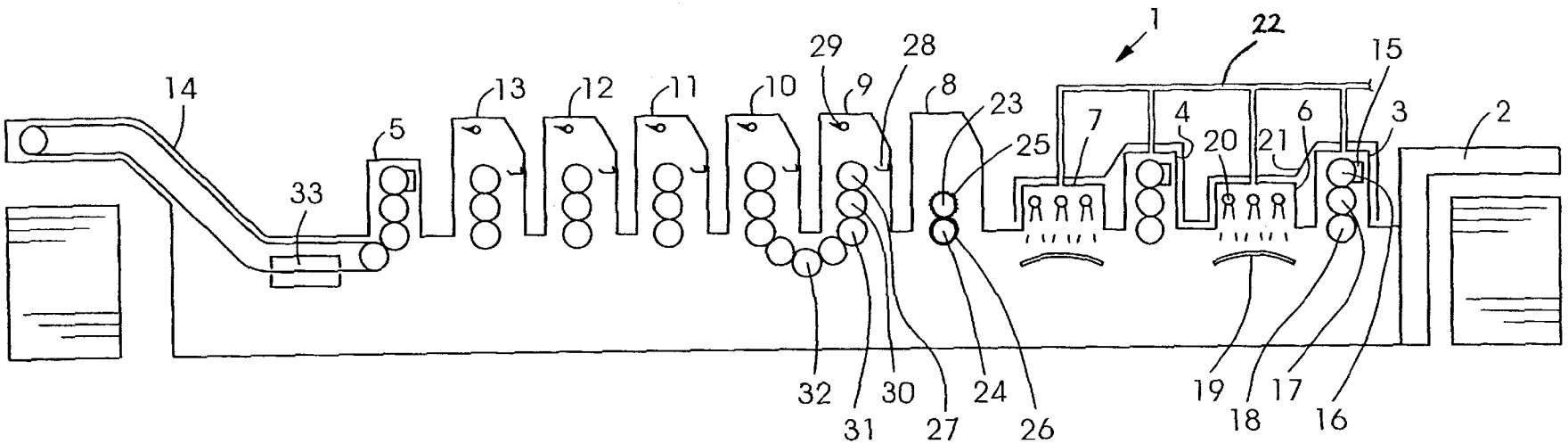
FIG. 1 is a diagrammatic view of a first exemplary embodiment of the invention.

Referring now to the figures of the drawing in detail and first, particularly, to FIG. 1 thereof, there is seen a printing machine 1. The embodiment is a sheet-fed rotary printing machine with a sheet feeder 2, a number of flexo printing units 3, 4 and 5, a number of drying units 6 and 7, at least one finishing unit 8, a number of offset printing units 9 to 13 and a sheet delivery 14.

Each of the flexo printing units 3, 4 and 5 comprises a chamber-type doctor 15, which is assigned a half-tone roll 16 for its dimples to be filled with ink, a printing-form cylinder 17 with a flexographic printing form clamped thereon and to be inked by the half-tone roll 16, and an impression cylinder 18, on which a sheet printing material 19 rests in order to be printed by means of the printing-form cylinder 17.

Each of the drying units 6 and 7 has its own two side walls and its own printing-material transport device arranged between these, for example at least one sheet transport drum, and is equipped with at least one blower nozzle 20 and preferably a row of blower nozzles 20, whose warm air stream, at a temperature of about 40° C. to 45° C., is directed onto the fresh printed image of the printing material 19 transported through the respective drying units 6 and 7, in order to dry the image in accordance with the impingement jet principle. Blowing on cold air at room temperature instead of the warm air can also be possible in specific cases.

If there is adequate installation space within the flexo printing units 3 and 4, the air-type dryers in each case downstream in the form of the drying units 6 and 7 can also be integrated directly into the flexo printing units 3 and 4. If only a single flexo printing unit 3 is arranged upstream of the offset printing unit 8 in the printing machine 1, it is of course also possible for the associated air-stream dryer to be integrated into the flexo printing unit.

In order to avoid the ignition of solvent vapors located therein, the flexo printing units 3 and 4 and the drying units 6 and 7 are provided with an explosion prevention device 21 and are connected to an extraction device 22 in order to extract these solvent vapors. Such devices 21 and 22 can also be provided for the finishing unit 8. The explosion prevention device 21 comprises the encapsulation of electrical drives, switches, sensors and the like, through which encapsulation the solvent vapors cannot penetrate, so that the solvent vapors cannot be ignited by any electrical contact-break sparks.

The finishing unit 8 comprises two embossing cylinders 23 and 24, on each of which a cylinder cover 25 and 26 is clamped, and which form a processing gap or processing nip through which the printing material 19 is led during rotary embossing. The cylinder cover 25 is a hard embossing die provided with elevated elements. The cylinder cover 26 can be designed to be elastically compressible, comparable with an offset rubber blanket, so that in the case of embossing the printing material 19 on one side, the elevated elements of the cylinder cover 25 can "dive" into the cylinder cover 26. The cylinder cover 26 can also be a rigid embossing die, whose recesses, when the printing material 19 is embossed on both sides, form the mating portions accommodating the elevated elements of the cylinder cover 25. For specific applications, the cylinder covers 25 and 26 can be clamped on the embossing cylinders 23 and 24 in an exchanged arrangement, as is shown by way of example in FIG. 2.

Each offset printing unit comprises a printing-form cylinder 27, whose planographic printing form, clamped on it, can be dampned by means of a dampening unit 28 and inked by means of an inking unit 29, and also comprises a blanket cylinder 30 for transferring the printing image from the printing-form cylinder 27 to the printing material 19, which resets on an impression cylinder 31 during printing.

In each case a printing-material transport system is arranged between each two immediately following units of the units 3 to 13 in the printing-material transport direction. Each transport system comprises at least one sheet transfer drum 32, as is shown by way of example using the offset printing units 9 and 10.

It is economically advantageous in production terms to design the finishing unit 8 on the basis of an offset printing unit which corresponds to the modular in-line design of the offset printing units 9 to 13. This mass-production offset printing unit can be converted into the finishing unit 8 shown by leaving out the printing-form cylinder 27, the dampening unit 28 and the inking unit 29. The printing-form and blanket cylinders of the offset printing unit can have their functions changed to the embossing cylinders 23 and 24 by means of adaptation work, for example by increasing the stability of their rotary bearings. Also, in the event that the printing-form and blanket cylinders are replaced by the embossing cylinders 23 and 24 during the conversion, the finishing unit 8 has very many identical parts with the offset printing units 9 to 13. These are, for example, the printing-unit side walls and the gear mechanisms for the rotary drive of the cylinders 30, 31 and 23, 24. The same applies to a design of the finishing unit 8 on the basis of a varnishing unit, which corresponds to the design of the flexo printing units 3 and 4, which is likewise economically advantageous in production terms. This mass-production varnishing unit can be converted to the finishing unit 8 by leaving out the half-tone roll 16 and the chamber-type doctor 15. The advantages which result from this correspond to those mentioned above in connection with the possible conversion of an offset printing unit 9 to 13.

The sheet delivery 14 is designed to correspond to the so-called lengthened design, as a result of which the transport path of the sheet printing material 19, held by a circulating chain gripper, has been lengthened and installation space has been created, which permits the integration of a dryer 33 into the sheet delivery 14. The dryer 33 is essentially a drying chamber through which the printing material 19 passes and which is connected to an air supply and an air extraction means.

The functioning of the printing machine 1 during label printing will be explained below.

Since the printing machine 1 is designed as a sheet-fed rotary printing machine, this can be used both to print a thin, lightweight label paper with a grammage of 70 g/m$^2$, for example, and also for printing heavy and stiff folding boxboard and cardboard stock.

The printing material 19 fed to the flexo printing unit 3 by the sheet feeder 2 arranged immediately upstream receives a first imprint in the flexo printing unit 3, using a first flexo printing ink. The printing material 19 is then transported to the drying unit 6 directly downstream of the flexo printing unit 3 in the sheet travel direction between the flexo printing units 3 and 4 and transported through these. The solvent evaporates very rapidly from the first imprint exposed to the air stream in the drying unit 6, so that the first imprint is already dry when a second imprint, which coincides with the first imprint in terms of location, is applied to the latter in the flexo printing unit 4, after the printing material 19 has been transferred from the drying unit 6 to the flexo printing unit 4.

The flexo printing inks printed in the flexo printing units 3 and 4 each contain metal pigments which give rise to the gold effect and which are bound in a binder that is composed of alcohol, as a rapidly evaporating solvent, and, if appropriate, additional other solvents, and of resins. However, the composition of the two flexo printing inks is not completely identical, so that these differ in terms of their viscosity. By means of different mixing conditions and different additives added to the two flexo printing inks, the properties of the two flexo printing inks can be matched in such a way that the flexo printing ink printed in the flexo printing unit 6 has the effect of particularly good coverage of the printing material, and the flexo printing ink printed in the flexo printing unit 7 has the effect of increasing the gloss. The viscosity of the flexo printing ink printed in the flexo printing unit 6 is preferably somewhat lower than the viscosity of the flexo printing ink printed in the flexo printing unit 7. It must be noted, however, that the viscosity of the two flexo printing inks is significantly lower than the viscosity of the highly viscous offset-typical printing inks printed in the offset printing units 9 to 13.

The printing material 19 transferred from the flexo printing unit 4 to the drying unit 7 is dried in the drying unit 7 in accordance with the same effective principle as in the drying unit 6, so that the second imprint is also completely dry when the printing material 19 is transferred to the finishing unit 8 from the drying unit 7 directly downstream of the flexo printing unit 4 and directly upstream of the finishing unit 8, in which processing so as to deform the printing material 19 is carried out.

In other embodiments of the printing machine 1, which differ from the exemplary embodiment shown in FIG. 1, it is possible for just the drying unit 6 to be omitted, or for the drying unit 6 together with the flexo printing unit 3 to be omitted.

In the printing machine 1 shown in FIG. 1, it is advantageous that the flexo printing units 3 and 4 are upstream of the finishing unit 8 in the printing-material transport direction.

By means of this configuration, half-tone dot deformations, which manifest themselves detrimentally in the printed image, are absolutely ruled out. Such half-tone dot deformations might be feared if the printing material 19 were to be given, before flexographic printing, an embossed structure into which the flexographic imprint was made. Flexographic half-tone dots printing into the depressed embossed regions would be less deformed than flexographic half-tone dots printing into embossed regions located higher. This would entail the depressed embossed regions being wetted with less ink than the higher embossed regions, which is therefore avoided by the configuration illustrated in FIG. 1.

The embossing of a so-called linen structure into the printing material 19, carried out in the finishing unit 8, can intersect the flexographic imprint already located on the printing material 19, and can also be offset with respect to this imprint.

In other embodiments of the printing machine 1, differing from the exemplary embodiment shown in FIG. 1, another cylindrical rotary tool for fluting, perforation, stamping or the like can be used for processing the printing material 19 instead of the embossing cylinder 23.

In the exemplary embodiment shown in FIG. 1, it is advantageous that intermediate drying is carried out by means of the drying unit 7 between the processing of the printing material 19 in the finishing unit 8 and the last printing of the printing material 19 in accordance with the flexographic printing principle, since in this way the deposition of fresh flexo printing ink on the cylinder cover 25 of the embossing cylinder 23 is prevented.

The sequence of flexographic printing, then separating and/or deforming processing (finishing ) and then offset printing is advantageous from many points of view.

On the one hand, paper particles which are possibly detached from the printing material 19 during the processing of the printing material 19 in the finishing unit 8 can no longer pass along the printing-material transport path onto the half-tone rolls 16, which are susceptible to contamination, and block up their dimples. By contrast, the offset printing units 9 to 13 are less susceptible to contamination and, if required, can be cleaned automatically in a particularly simple way at regular intervals. When the printing material 19 passing through the printing machine 1 reaches the flexo printing unit 5 directly upstream of the sheet delivery 14, the paper particles which may be present have already left the printing material 19 during its transport.

On the other hand, the rubber blankets of the blanket cylinders 30 in the offset printing units 9 to 13 even out the elevated and depressed embossed points, so that it is possible, by means of the offset printing units 9 to 13, to print into the already previously embossed regions of the printing material with area coverage values which are suitable for the printed image. However, the offset printing can also be carried out in a manner offset from the embossed regions of the printing material.

The printing machine 1 advantageously comprises more than four and, for example, five or six offset printing units for printing the same side of the printing material, so that, in addition to the four-color print produced by the offset printing units 9 to 12 and using the standard colors black, cyan, magenta and yellow, a specially mixed special color deviating from these standard colors can be printed in the printing unit 13.

After the printing material 19 has passed through the offset printing units 9 to 13, the printing material 19 is transferred from the last offset printing unit 13 to the flexo printing unit 5 directly downstream. A dryer arranged between the printing units 13 and 5 for drying the offset print is not absolutely necessary, since the offset printing inks, consisting of resins, mineral oils and drying oils, reach a level of drying sufficiently quickly which permits them to be varnished over without additional drying measures, as a result of absorption and oxidation.

The flexo printing unit 5 functions as a varnishing unit for applying a clear varnish layer which covers the offset printed image and which preferably does not cover the flexographic printed image, so that any reduction in the metallic gloss of the flexographic printed image by the aqueous clear varnish is avoided. The drying of the clear varnish layer or the removal of the water solvent from the latter is carried out by means of the dryer 33 downstream of the flexo printing unit 5, after the printing material 19 has been transferred from the flexo printing unit 5 to the sheet delivery 14.

Figure 2:
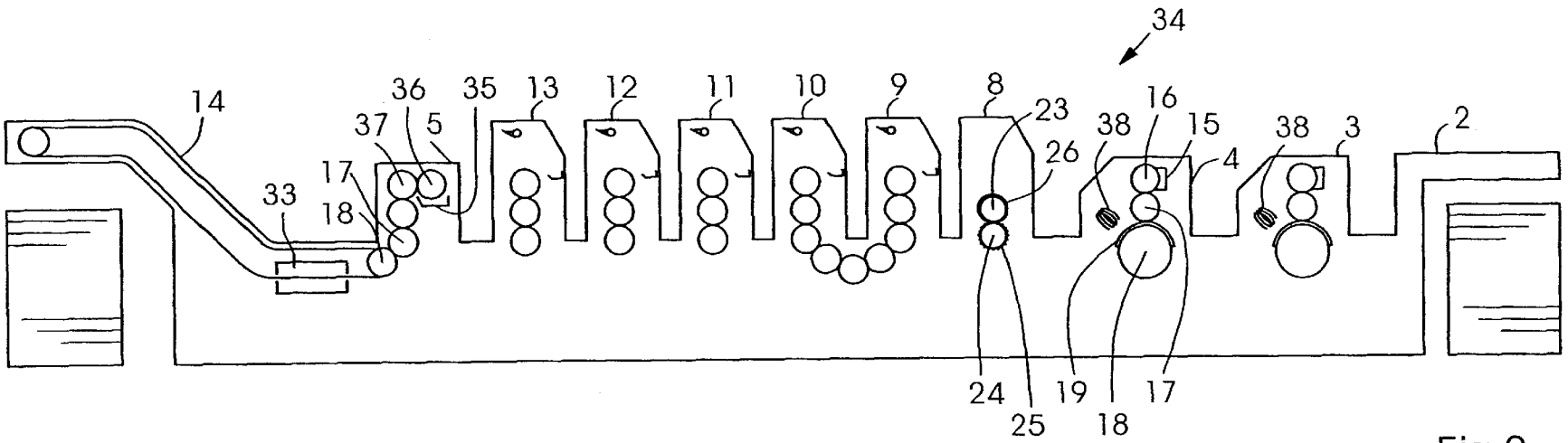
FIG. 2 is a diagrammatic view of a second exemplary embodiment of the printing machine according to the invention.

Referring now to FIG. 2, the printing machine 34 illustrated therein corresponds to the printing machine 1 from many points of view. Accordingly, in FIGS. 1 and 2, the same reference symbols are used to identify common features, and the features already described in connection with the printing machine 1 will not be described again with regard to the printing machine 34. In the following text, therefore, only the features by which the printing machine 34 differs from the printing machine 1 will be discussed in detail.

The flexo printing unit 5 of the printing machine 34 has, instead of the chamber-type doctor 15 and the half-tone roll 16, an ink or varnish feed device, comprising a pan 35 and two rolls 36 and 37, for inking the printing-form cylinder 17. The pan roller 36 scoops the water-based ink or the emulsified varnish from the pan 35 so that the ink can then be accepted by the metering roller 37 resting on the pan roller 36 and can be transferred to the flexographic printing form clamped on the printing-form cylinder 17.

The above-described dip-roll system of the flexo printing unit 5 of the printing machine 34 can be used in the printing machine 1 instead of the chamber-type doctor system of the flexo printing unit 5 of the latter. Likewise, the chamber-type doctor system of the flexo printing unit 5 of the printing machine 1 can be used in the printing machine 34 instead of the dip-roll system 5 of the latter. Irrespective of whether the flexo printing unit 5 is equipped with the chamber-type doctor system or with the dip-roll system, in both printing machines 1 and 34 a rubber blanket or varnishing blanket can be clamped onto the cylinder 17 instead of the flexographic printing form for the purpose of varnishing the whole area of the printing material 19 without varnishing gaps. In the case of such a modification, the terms "varnishing cylinder 17"—instead of printing-form cylinder 17—and "varnishing unit 5"—instead of flexo printing unit 5—are the more accurate designations.

The printing machine 34 differs from the printing machine 1 mainly in the fact that the drying units 6 and 7 are not present in the printing machine 34, so that, as viewed in the direction of transport of the printing material, the flexo printing unit 3, the flexo printing unit 4 and the finishing unit 8 follow one another directly in the afore-mentioned sequence. Integrated into each flexo printing unit 3 and 4 is a UV dryer 38, whose light radiation is directed over the entire format width of the printed image onto the fresh printed image on the printing material 19 transported through the respective flexo printing unit 3 and 4.

In the printing units 5 and 9 to 13 of the printing machine 34, precisely the same inks are printed as in the printing units, designated by the same reference symbols, in the printing machine 1 and, in the flexo printing units 3 and 4 of the printing machine 34, so-called UV inks are printed instead of the solvent-based inks drying by evaporation. The UV inks differ from the solvent-based inks in a completely different type of binder, which is composed of a mixture of polymers—monomers, prepolymers and photoinitiators—, the quantity of low-viscosity monomers contained in the respective UV ink determining the viscosity, so that the viscosities of the UV inks can likewise be stepped, as has already been described in connection with the solvent-based flexographic inks used in the printing machine 1. The UV ink dries without any components of the binder evaporating or being absorbed to any noticeable degree, in a drying process which proceeds rapidly following the UV irradiation of the printing material 19. As a result of the UV irradiation, the photoinitiator is activated and transfers energy to the binder, which polymerizes as a result and forms a dry, hard ink film which, as a result of the metal pigments incorporated into the binder, has approximately the same gold-colored optical properties as the dried solvent-based inks. Each UV dryer 38 is preferably formed by one or more mercury vapor lamps and reflects the UV radiation in the direction of the respective impression cylinder 18, so that the printing material 19 resting on the latter is dried.

As distinct from the exemplary embodiment shown in FIG. 2, it is conceivable, if there are constricted installation space conditions within the flexo printing units 3 and 4, for the UV dryers 38 to be comparable in terms of arrangement with the drying units 6 and 7 of the printing machine 1 and, like the latter, also to be arranged in their own side walls as separate UV drying units downstream of the flexo printing units 3 and 4. Also, in applications requiring the application of a low UV-ink layer thickness, a single flexo printing unit 3 with integrated dryer 38 or downstream UV drying unit can be sufficient. It is likewise conceivable to print the UV inks "wet on wet", it being possible for the UV dryer 38 of the flexo printing unit 3 to be dispensed with and for the UV dryer 38 integrated into the flexo printing unit 4, or a single UV drying unit directly downstream of the flexo printing unit 4, to be sufficient.

Figure 3:
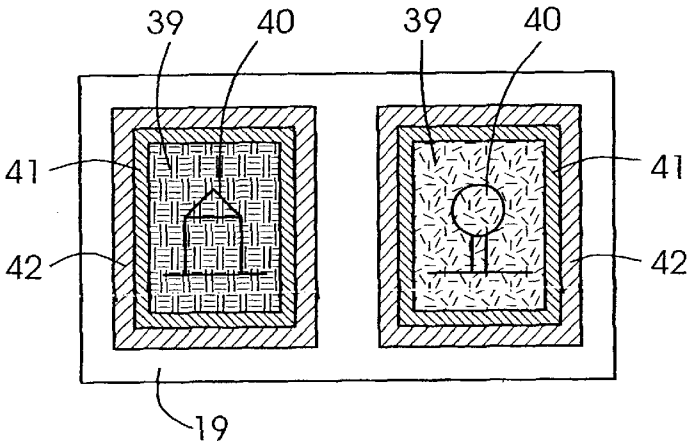
FIG. 3 is a plan view of a printing material with a printed image.

FIG. 3 illustrates a plan view of the printing material 19 delivered by the sheet delivery 14 and having a complete printed image. Although the drying principles used one after another in the printing machines 1 and 34—printing machine 1: evaporation, oxidation, evaporation, and printing machine 34: polymerization, oxidation, evaporation—differ from one another to some extent, the printed products produced on the different printing machines 1 and 34 are virtually indistinguishable from each other visually and have the same, high print quality. For this reason, the following description of the printed product relates both to the printed product which results from the in-line process carried out on the printing machine 1, and to the printed product which is the result of the in-line process carried out on the printing machine 34.

A number of label images are printed onto the sheet printing material 19 and, in order to illustrate the technical possibilities of the in-line process, have motifs which are different in FIG. 3. In practice they are generally the same. A linen-like background structure for the four-color image 40 printed onto the structure by means of the offset printing units 9 to 12 has been embossed into the rectangular printing-material area 39 of the left-hand label by means of the finishing unit 8. The printing-material area 41 is a gold decorative frame, which surrounds the printing-material area 39. The decorative frame has been produced by means of a multilayer application of the solvent-based or radiation-curing metallic ink in the flexo printing units 3 and 4. The printing-material area 41 is adjoined on the outside by a further frame-like printing-material area 42, which is covered by the special ink printed by the offset printing unit 13. As the upper, final layer, the printing-material areas 39 and 42 have been covered with a protective varnish made of water-based clear varnish, the protective varnish not covering the printing-material area 41.

The right-hand label differs from the left-hand label described above in that a different fine structure has been impressed into its printing-material area 39, in that a different multicolor motif 40 has been printed onto the fine structure, and the transparent protective varnish applied by means of the flexo printing unit 5 has not been left out in the region of the metallically printed printing-material area 41, and therefore completely covers all the printing-material areas 39, 41 and 42.

It will be understood that a protective varnish can also completely cover a number of labels or the entire printing format of the printing material 19.

We claim:

1. A printing method, which comprises:

printing a printing material in a combined printing process with two ink systems, and thereby first printing onto the printing material an ink selected from the group of solvent-based inks and radiation-curing inks;

subsequently creating an embossing structure of the printing material by embossing the printing material; and subsequently printing onto the embossing structure at least one offset ink with an offset printing process.

2. The method according to claim 1, wherein the ink selected in the first printing step is a metallic ink.

3. The method according to claim 1, wherein the first printing step comprises printing the printing material several times with inks selected from the group consisting of solvent-based and radiation-curing inks prior to printing with the offset ink.

4. The method according to claim 1, wherein the first printing step comprises a flexographic printing process.

5. The method according to claim 1, which comprises intermittently drying the printing material after each printing with solvent-based ink by supplying air.

6. The method according to claim 1, which comprises drying the printing material after each printing with radiation-curing ink by performing a process selected from the group consisting of UV irradiation and electron irradiation.

7. The method according to claim 1, which further comprises, after the step of printing with the offset ink, printing the printing material with a water-based ink.

8. The method according to claim 7, wherein the printing material is finally printed with a clear varnish.

9. The method according to claim 7, wherein the final printing step comprises printing with a flexographic printing process.

10. The method according to claim 1, wherein the embossing step comprises finely structuring the printing material.

11. The printing method according to claim 1, which comprises performing the printing steps inline with a hybrid printing machine having;

a flexo printing unit;

an offset printing unit disposed downstream of the flexo printing unit in a travel direction of printing product through the printing machine; and a dryer selected from the group consisting of a UV dryer, an electron-beam dryer, and an air-stream dryer integrated in the flexo printing unit.

12. The printing method according to claim 1, which comprises performing the printing steps inline with a hybrid printing machine having:

a flexo printing unit;

an offset printing unit disposed downstream of the flexo printing unit in a travel direction of printing product through the printing machine; and a dryer selected from the group consisting of a UV dryer, an electron-beam dryer, and an air-stream drying unit disposed between the flexo printing unit and the offset printing unit.

* * * * *

UNITED STATES PATENT AND TRADEMARK OFFICE

CERTIFICATE OF CORRECTION

PATENT NO. : 6,443,058 B1
DATED : September 3, 2002
INVENTOR(S) : Peter Stadler et al.

It is certified that error appears in the above-identified patent and that said Letters Patent is hereby corrected as shown below:

Column 7,
Line 2, should read as follows:
-- printing unit 3 has the effect of particularly good coverage --.
Line 4, should read as follows:
-- the flexo printing unit 4 has the effect of increasing the gloss. --.
Line 6, should read as follows:
-- printing unit 4 is preferably somewhat lower than the --.
Line 8, should read as follows:
-- printing unit 4. It must be noted, however, that the viscosity --.

Column 11,
Line 19, should read as follows:
-- The method according to claim 7, wherein the step of printing with the water-based ink comprises printing with a flexographic printing process. --.

Signed and Sealed this

Twentieth Day of September, 2005

JON W. DUDAS
*Director of the United States Patent and Trademark Office*